US007818949B2

(12) United States Patent
Leplatois et al.

(10) Patent No.: US 7,818,949 B2
(45) Date of Patent: Oct. 26, 2010

(54) APPARATUS FOR BAGGING MATERIAL

(75) Inventors: Ludovic Leplatois, Montrèal (CA); Julien Lefebvre, Repentigny (CA); Roger Tambay, Rosemére (CA)

(73) Assignee: Les Plastiques Balcan Limitée, St-Leonard, Quebec (CA)

( * ) Notice: Subject to any disclaimer, the term of this patent is extended or adjusted under 35 U.S.C. 154(b) by 0 days.

(21) Appl. No.: 12/037,344

(22) Filed: Feb. 26, 2008

(65) Prior Publication Data

US 2008/0141633 A1 Jun. 19, 2008

Related U.S. Application Data

(62) Division of application No. 11/669,511, filed on Jan. 31, 2007, now abandoned.

(51) Int. Cl.
*B65B 9/14* (2006.01)

(52) U.S. Cl. ..... 53/459; 53/457; 53/469

(58) Field of Classification Search ..... 53/399, 53/457, 459, 467–469
See application file for complete search history.

(56) References Cited

U.S. PATENT DOCUMENTS

| | | | | | |
|---|---|---|---|---|---|
| 4,454,705 | A * | 6/1984 | Benno | 53/399 |
| 4,473,990 | A * | 10/1984 | Thimon | 53/567 |
| 4,724,658 | A * | 2/1988 | Birkenfeld et al. | 53/557 |
| 5,168,989 | A * | 12/1992 | Benno | 206/143 |
| 6,032,439 | A * | 3/2000 | Birkenfeld et al. | 53/441 |
| 6,161,365 | A * | 12/2000 | Girard et al. | 53/441 |
| 6,298,636 | B1 * | 10/2001 | Lachenmeier et al. | 53/442 |
| 6,662,535 | B2 * | 12/2003 | Pin | 53/556 |
| 2002/0139089 | A1 * | 10/2002 | Pin | 53/459 |

* cited by examiner

*Primary Examiner*—Christopher Harmon
(74) *Attorney, Agent, or Firm*—Ogilvy Renault LLP

(57) ABSTRACT

An apparatus (10) for bagging material into a stretchable bag having an open end, comprises a movable bag stretching structure (18) displaceable between a first position for receiving the bag and a second position for holding the bag in a stretched state, wherein said stretching structure (18) is provided with elongated corner members (70, 72) for accumulating the bag thereon, each of said elongated corner members (70, 72) being provided with a movable strap-like member (210) extending along the length of the corner members (70, 72) to facilitate loading and unloading the bag on and from the corner members (70, 72).

2 Claims, 8 Drawing Sheets

APPARATUS FOR BAGGING MATERIAL

RELATED APPLICATIONS

This application is a divisional of U.S. application Ser. No. 11/669,511 filed Jan. 31, 2007, now abandoned, which claims benefit of International Patent Application No. PCT/CA2006/002115 filed Dec. 22, 2006, which claims benefit of U.S. Provisional Application No. 60/752,913 filed Dec. 23, 2005.

BACKGROUND OF THE INVENTION

1. Field of the Invention

The present invention relates to an apparatus and a method for bagging goods, such as bundles of wood, in stretchable bags.

2. Description of the Prior Art

Some wood products, such as rectangular bundles of lumber strips, need to be protected from the environment and stored in a way such as to preserve an appropriate degree of humidity and prevent UV rays from damaging the wood.

In the past, various bagging apparatuses have been developed to load agricultural products into stretchable plastic tubes. However, there is still a need for a new apparatus and method for providing effective and convenient bagging or sheathing of rigid wood products into stretchable bags or the like.

More particularly, there is a need to more uniformly distribute the tension exerted on the film during the bagging process in order to improve the overall quality of the bag and package and prevent accidental tearing of the bagging material. There is a need to find a new bagging process and apparatus allowing the use of thinner bagging material in order to reduce the packaging costs.

SUMMARY OF THE INVENTION

It is therefore an aim of the present invention to provide an apparatus and a method for wrapping material, such as bundles, into stretchable bags.

It is also an aim of the present invention to provide such an apparatus which is adapted to more evenly distribute the tension in the bagging material and prevent excessive stress concentration therein.

It is a further aim of the present invention to provide improved packaging quality at less cost.

It is still a further aim of the present invention to provide an apparatus which reduces or minimizes the stress induced into the sheathing material, thereby allowing the use of thinner film materials.

Therefore, in accordance with the present invention, there is provided an apparatus for bagging material into a stretchable bag having an open end, comprising a movable bag stretching structure displaceable between a first position for receiving the bag and a second position for holding the bag in a stretched state, wherein said stretching structure is provided with elongated corner members for accumulating the bag thereon, each corner member having a distal end with an arcuate cross-section.

In accordance with a further general aspect of the present invention, there is provided an apparatus for bagging material into a stretchable bag having an open end, comprising a movable bag stretching structure displaceable between a first position for receiving the bag and a second position for holding the bag in a stretched state, wherein said stretching structure is provided with an elongated corner members for accumulating the bag thereon, each corner member being provided with a movable strap-like member to facilitate loading and unloading the bag on and from the corner members.

According to a further general aspect, there is provided a method of bagging an article into a bag comprising: a) providing a bag having an opening for receiving the article, b) loading the bag on first and second pairs of corner members of a stretching apparatus, the corners members being displaceable along first an second orthogonal directions, c) displacing the second pair of corner members away from said first pair of corner members along said first direction, d) displacing said corner members of said first pair away from one another along said second direction while at the same time displacing said corner members of said second pair in said first and second orthogonal directions away from said corner members of said first pair, e) further displacing said second pair of corner members away from said first pair of corner members along said first direction, and f) lowering the bag in a taut open state over the article.

BRIEF DESCRIPTION OF THE DRAWINGS

Reference will now be made to the accompanying drawings, showing by way of illustration a preferred embodiment thereof, and in which.

DESCRIPTION OF THE PREFERRED EMBODIMENTS

Figure 1:
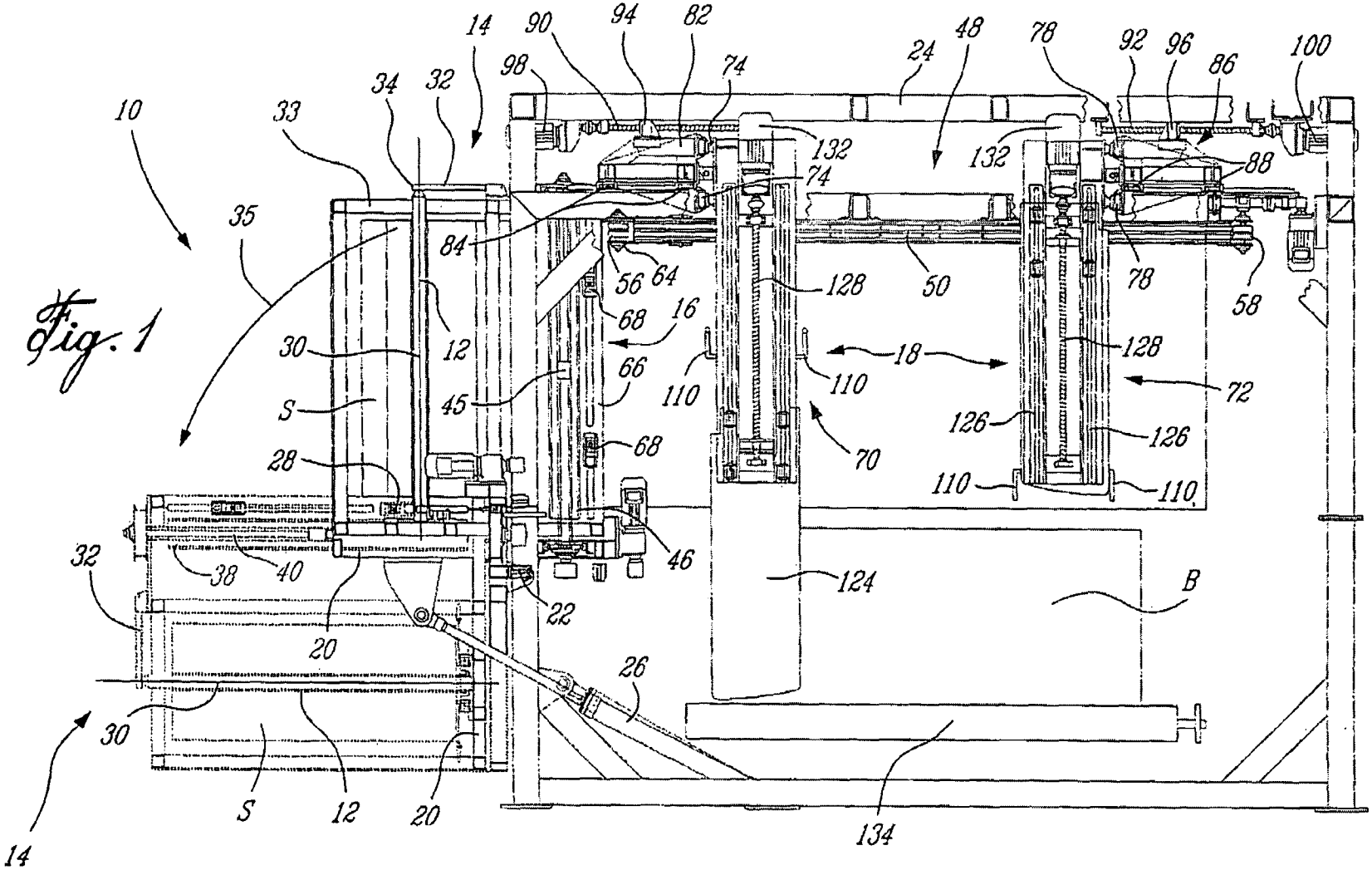
FIG. 1 is a side elevation view of a bagging apparatus in accordance with a preferred embodiment of the present invention.

Now referring to the drawings, and in particular to FIG. 1, a bagging apparatus 10 suited for sheathing or bagging a substantially rectangular or square bundle B of wood within a resilient sheath S will be described.

The film or sheath S is provided in the form of an elongated web of flexible, stretchable, resilient plastic material that is folded in two about a central longitudinal axis thereof and then rolled on a mandrel or supply reel 12 with the fold line of the sheath S forming the upper edge of the roll of material (i.e. the sheath S is folded in an inverted "V" configuration on the reel 12).

The bagging apparatus 10 generally comprises a supply unit 14, a sealing and cutting unit 16 and a stretching and bagging unit 18.

The supply unit 14 comprises a loading platform 20 pivotally mounted at 22 to a rectangular framework 24 supporting the sealing and cutting unit 16 and the stretching and bagging unit 18 of the apparatus 10. A hydraulic cylinder 26 extends between the framework 24 and the loading platform 20 to pivot the latter between a horizontal functional position and a vertical loading position (both positions being shown in solid lines in FIG. 1). A motorized turntable 28 is mounted on the platform 20. An axle 30 extends at right angles from the turntable 28 for receiving the supply reel 12. A pivot arm 32 is pivotally mounted to a frame structure 33 mounted to the platform 20 for receiving the free distal end of the axle 30 once the supply reel 12 has been loaded thereon. A lock pin 34 is provided to lock the pivot arm 32 to the axle 30, thereby preventing axial withdrawal of the reel 12 from the axle 30.

To load a new supply reel on the axle 30, the platform 20 is first pivoted from its horizontal position to the vertical position thereof, as indicated by arrow 35 in FIG. 1; second, the lock pin 34 is removed and the pivot arm 32 is manually pivoted away from the axle 30; and finally, the reel 12 is slidably fitted on the axle 30. Thereafter, the pivot arm 32 is pivoted back in engagement with the axle 30 and locked thereto, and the cylinder 26 is extended to pivot the platform 20 back to its horizontal position. A brake 36 (FIG. 2) is provided for engaging the turntable 28 to prevent the sheath S from being unrolled from the supply reel 12 when required or desired.

Figure 2:
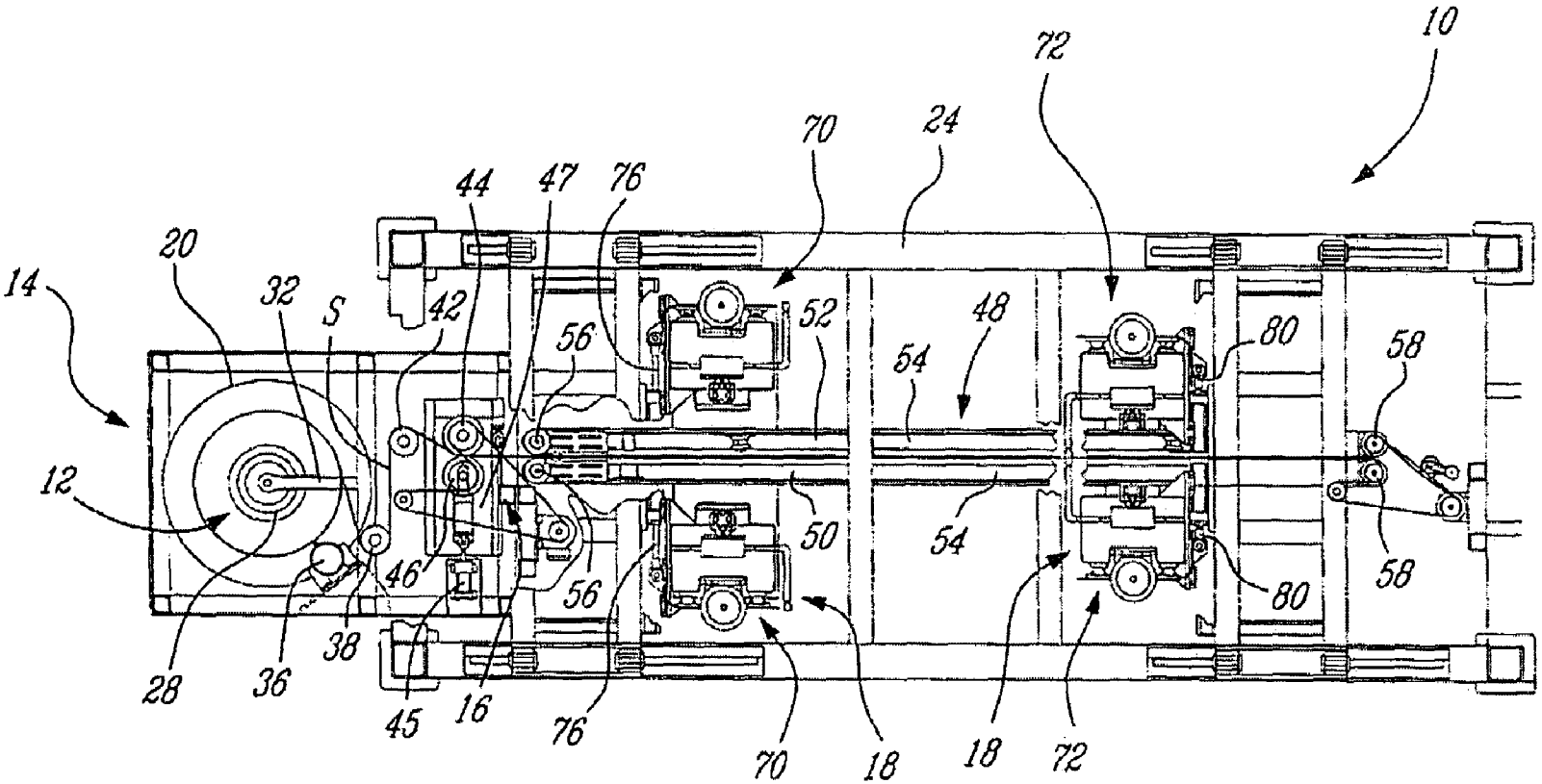
FIG. 2 is a top plan view of the bagging apparatus of FIG. 1.

As shown in FIGS. 1 and 2, the sheath S is directed from the supply reel 12 to a first pre-stretching motorized roller 38 mounted on a vertical shaft 40 which is, in turn, mounted on the loading platform 20. A second pre-stretching motorized roller 42 (FIG. 2) is provided on the framework 24 for receiving the sheath S from the first pre-stretching roller 38. The first and second pre-stretching rollers 38 and 42 cooperate to pre-stretch the sheath S so as to subsequently facilitate the full stretching thereof in the stretching and bagging unit 18. Two or more set of pre-stretching rollers driven at increased speed from one set to the next can be provided for pre-stretching the sheath S before the same is transferred to the stretching and bagging unit 18.

From the second pre-stretching roller 42, the sheath S is directed between a pair of indexing motorized vertical rollers 44 and 46 supported by the framework 24. As seen in FIG. 2, the roller 46 is mounted to a support 47. A pneumatic cylinder 45 is provided for linearly reciprocating the support 47 and, thus, the roller 46 away from and towards the roller 44. In use, the roller 46 is initially displaced away from the roller 44 to an open position for receiving the sheath S and then displaced back against the sheath S and the roller 44 to a closed functional position for drawing the sheath S forward into the apparatus 10.

Figure 3:
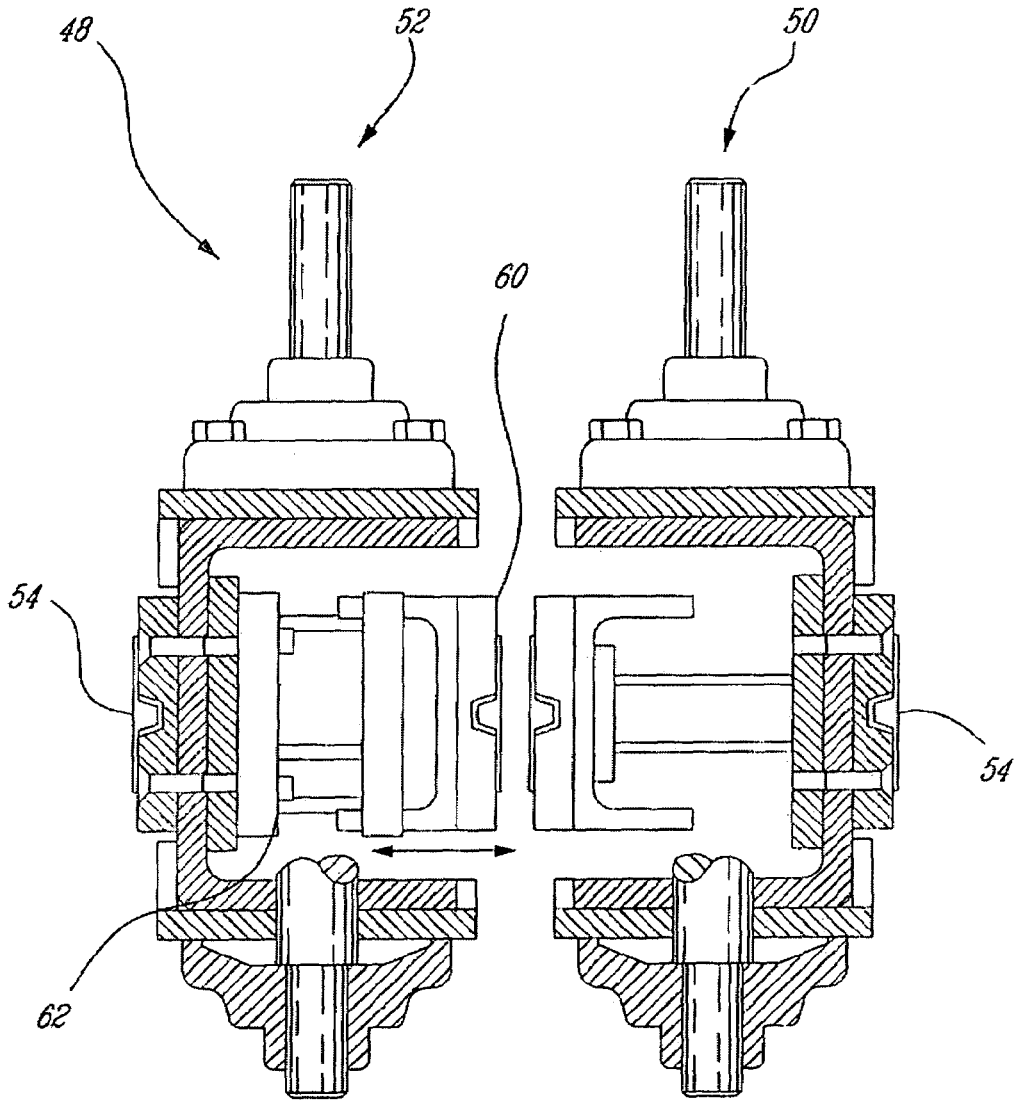
FIG. 3 is a cross-sectional view of a pair of side-by-side belt conveyors forming part of the apparatus of FIG. 1.

The sheath S is transferred from the indexing rollers 44 and 46 to an overhead transport rail system 48 mounted to the framework 24. As seen in FIG. 2, the overhead transport rail system 48 includes a pair of side-by-side axially extending belt conveyors 50 and 52 adapted to receive therebetween the upper end of the sheath S (i.e. the end with the fold line). The belt conveyors 50 and 52 each include an endless flexible belt 54 extending over a pair of axially spaced-apart rollers 56 and 58. The roller 58 of each pair is motorized to drive the associated belt 54. The belt 54 of the conveyor 52 slides between rollers 56 and 58 on a movable plate 60 (FIG. 3) displaceable towards, and away from, the other belt conveyor 50 so as to close or open the gap defined between the conveyors 50 and 52. A pair of pneumatic cylinders 62 (FIG. 3) are provided for displacing the plate 60. When the overhead transport system 48 is used to transport the sheath S forwardly through the apparatus 10, the cylinders 62 are extended and when it is desired to release the sheath S, the cylinders 62 are retracted so as to increase the gap between the belts 54 of the conveyors 50 and 52.

As seen in FIG. 1, the rollers 56 and 58 of the conveyors 50 and 52 are mounted on respective shafts 64. The position of the rollers 56 and 58 is adjustable along the shafts 64 for allowing the apparatus 10 to be used in conjunction with sheaths of different sizes.

As shown in FIGS. 1 and 2, the sealing and cutting unit 16 is mounted to the framework 24 between the indexing rollers 44 and the overhead transport rail system 48. The sealing and cutting unit 16 generally comprises a vertically displaceable cutting blade (not shown) and a pair of vertically extending elongated heating elements 66 facing each other from opposite sides of the central axis of the apparatus 10. The heating elements 66 are positioned to receive the sheath S therebetween and are displaceable towards, and away from, each other between a closed operative position and an open idle position. Pneumatic cylinders, such as those illustrated at 68 in FIG. 1, are provided for displacing the heating elements 66 between the open and closed positions thereof. Each heating element can be provided with a pair of heating bands (not shown) to simultaneously seal the sheath S on each side of the cut. It is also understood that a linear actuator (not shown) is provided for displacing the cutting blade in upward and downward directions to effect cutting of a desired length of sheath S.

Referring to FIGS. 1 and 2, it can be seen that the stretching/bagging unit 18 comprises an upstream pair of stretching columns 70 and an identical pair of downstream stretching columns 72. The upstream stretching columns 70 are slidably mounted in linear front transversal rails 74 (FIG. 1) and are displaceable towards, and away from, each other by means of a pair of cylinders 76 (FIG. 2) mounted in an end-to-end relationship between the upstream stretching columns 70. Likewise, the downstream stretching columns 72 are slidably mounted in linear transversal rails 78 and are displaceable towards, and away from, each other by means of a pair of cylinders 80 mounted in an end-to-end relationship between the downstream stretching columns 72. The transversal rails 74 form part of a front carriage 82 mounted in linear axially extending rails 84 provided on top of the framework 24. Similarly, the transversal rails 78 form part of a rear carriage 86 mounted in linear axially extending rails 88 provided on top of the framework 24. First and second ball screws 90 and 92 are respectively engaged with first and second ball nuts 94 and 96 for respectively displacing the front and rear carriages 82 and 86 along the longitudinal axis of the apparatus 10, as illustrated in FIG. 1. The first and second ball screws 90 and 92 are driven by respective electric rotary motors 98 and 100. Accordingly, the ball screws 90 and 92 are operable to displace the pair of upstream stretching columns 70 and the pair of downstream stretching columns 72 towards, and away from, each other along the longitudinal axis of the apparatus 10.

Figure 6:
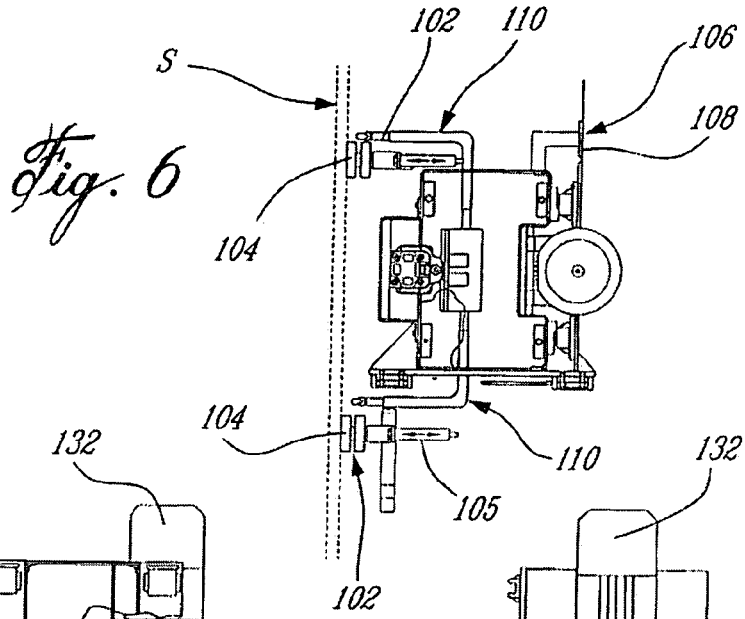
FIG. 6 is a schematic top plan view of the stretching column of FIG. 4.
Figure 5:
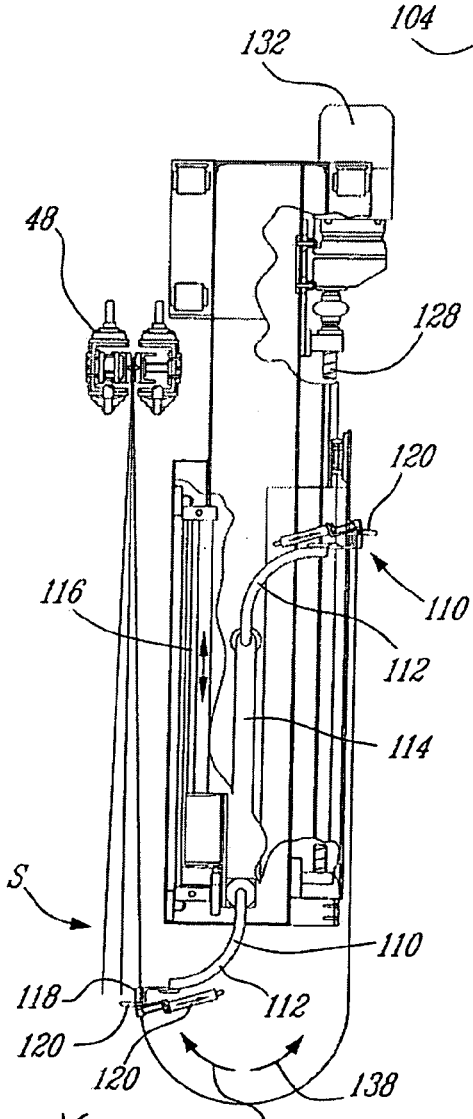
FIG. 5 is a schematic front elevation view of the stretching column of FIG. 4.
Figure 4:
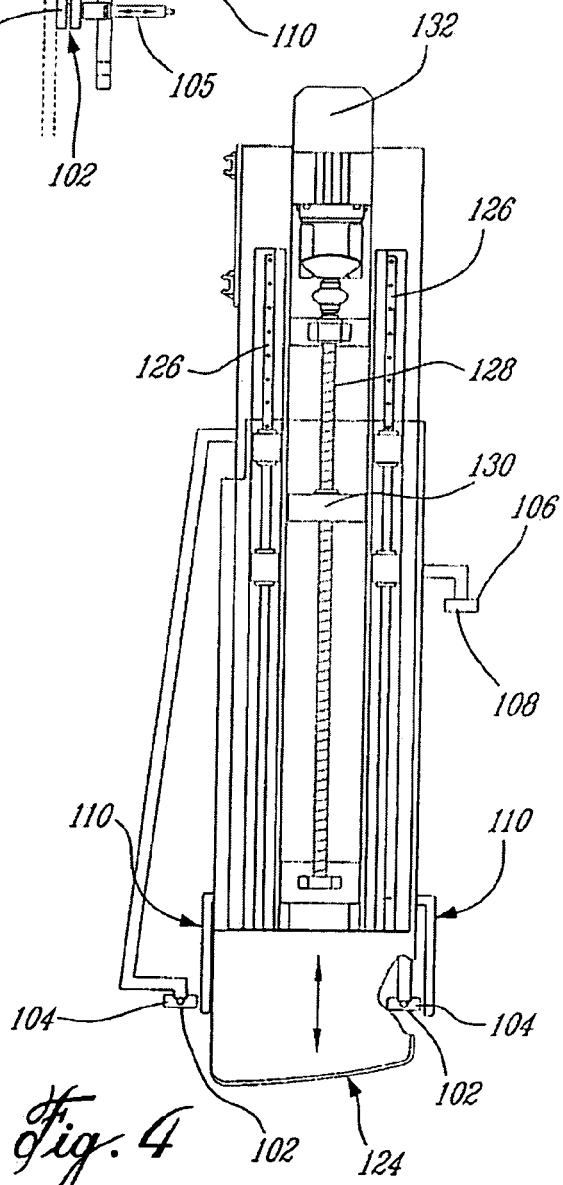
FIG. 4 is a schematic side elevation view of a stretching column forming part of a stretching and bagging unit of the apparatus of FIG. 1.

As seen in FIGS. 4, 5 and 6, each column 70/72 comprises on opposed sides thereof a pair of lower suction members 102 for opening the sheath S after the same has been cut and sealed so as to form a bag open at its bottom (FIG. 5). Each lower suction member 102 includes a hollow perforated planar head 104 which is connected to a pneumatic cylinder 105 (FIG. 6) for allowing the same to be linearly displaced relative to the associated column 70/72 towards and away from the sheath S. A vacuum pump (not shown) or the like is provided for drawing air into the suction members 102 through the perforated heads 104 thereof. Each column 70/72 is further provided with an upper suction member 106 having a perforated face plate 108 through which air can be drawn by operation of the vacuum pump. As opposed to the perforated heads 104 of the lower suction members 102, which are located on the inner side of the columns 70 and 72, the perforated face plates 108 of the upper suction members 106 are located on the outer side of the columns 70 and 72 so as to retain the bag when the same has been turned inside out over the columns 70 and 72, as will explained hereinbelow.

Each stretching column 70/72 is further provided on opposed lateral sides thereof with a pair of rotary gripping arms 110. As seen in FIG. 5, each rotary gripping arm 110 includes an arcuate arm segment 112 which is 180 degrees pivotable relative to the associated column 70/72 for allowing the bag to be turned inside out over the columns 70 and 72. Each rotary gripping arm 110 is linearly displaceable in a vertical slot 114 defined in the associated column 70/72. An actuator 116, such as a rodless TOL-O-MATIC actuator, can, be provided within each column 70/72 for linearly displacing the associated pair of rotary gripping arms 110.

Each rotary gripping arm 110 is provided with a stationary gripping finger 118 and a pivotable gripping finger 120. A pneumatic cylinder 122 is provided for displacing the pivotable gripping finger 120 between an open position and a closed position wherein the pivotable gripping finger 120 is urged against the associated stationary finger 118 to clamp a side of the bag at the mouth thereof.

Finally, as shown in FIG. 4, each column 70/72 is provided with a vertically movable sheath lowering plate 124. The sheath lowering plate 124 is mounted in a pair of vertical rails 126 provided on an outer side of the associated column 70/72. The sheath lowering plate 124 is displaced along the rails 126 in opposed ascending and descending directions by means of a ball screw 128 engaged with a ball nut 130 secured to the sheath lowering plate 124. An electric motor 132 is provided for driving the ball screw 128 and, thus, cause displacement of the plate 124.

Figure 8:
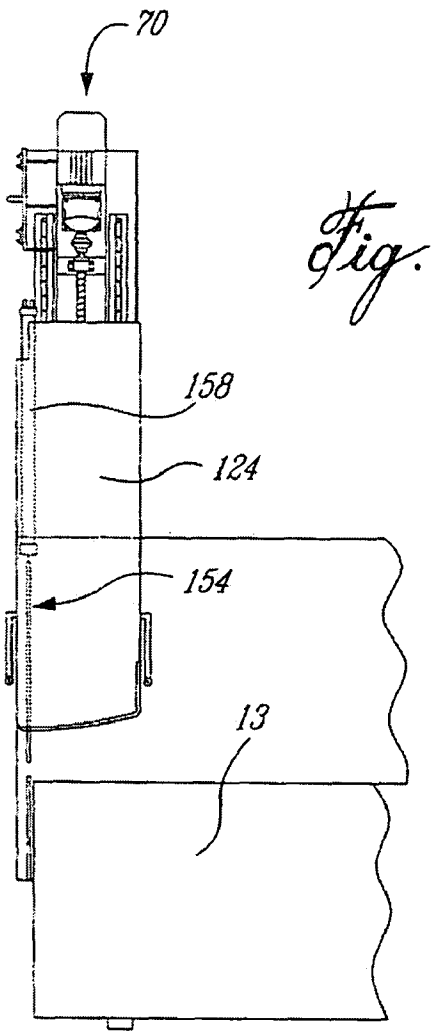
FIG. 8 is a simplified side elevation view of one of the stretching column and associated folding system of FIG. 7.

It is also contemplated to equip one of the front columns 70 and one of the rear columns 72 with a tip folding system 150 (FIGS. 7 and 8) to fold down or press down the triangular tip 152 formed by the seams at the upstream and downstream ends of the sheath or bag. As exemplified in connection with the columns 70, each tip folding system 150 is operational to place the tip 152 of the associated seam of the bag against the corresponding face of the bundle B to be bagged so that when the bag is inverted onto the bundle B, the tip 152 of the seam is folded into the outer surface of the bag itself, as opposed of extending upwardly from one end of the bundle B.

Figure 7:
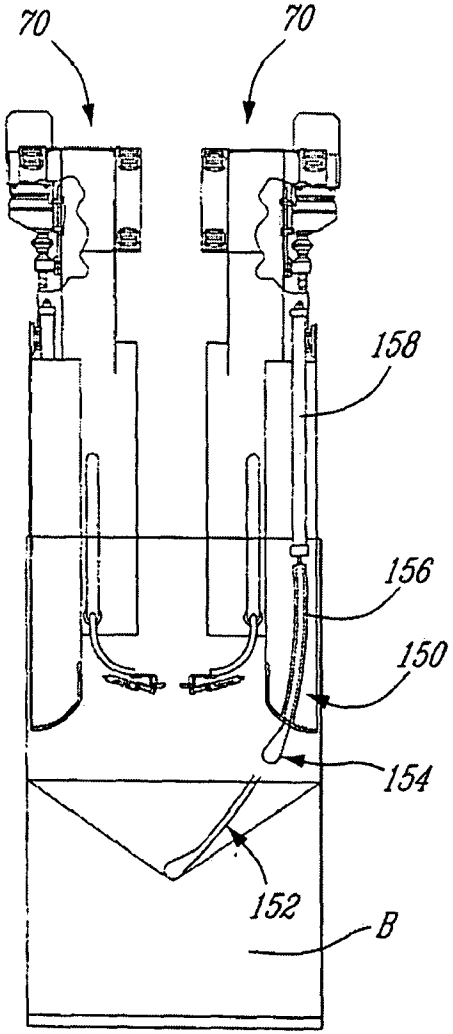
FIG. 7 is a simplified front end elevation view of a pair of stretching column, one of which is equipped with a tip folding system in accordance with one aspect of the present invention.

Each tip folding system 150 generally includes an arcuate arm 154 slidable between an extended position (shown in broken lines in FIG. 7) and a retracted position within a guiding structure 156 provided on an inner facing side of the associated column 70/72. The arm 154 is displaced by operation of a pneumatic cylinder 158 mounted within the column 70/72. According to one embodiment of the present invention, the pneumatic cylinder 158 has a 36 inches stroke. By extending the pneumatic cylinder 158 while the bag is stretched and turned inside out over the columns 70 and 72, the arm 154 is lowered so as to place and maintain the tip 152 of the seam against the associated end face of the bundle B, as illustrated in FIG. 7. The subsequent lowering of the vertically movable sheath lowering plate 124 will cause the bag to be inverted onto the bundle B with the tip 152 covered by or folded into the exterior surface of the bag so as to form a pleat in the bag at each end of the bagged bundle. After the folding operation, the pleat formed by the tip 152 can be sealed or otherwise secured in place to prevent the same from being unfolded while the bagged bundle is transported from one location to another.

As seen in FIG. 1, the bundle B is supported in position within the framework 24 underneath the overhead transport system 48 by a roller conveyor 134. It is understood that an entry conveyor (not shown) and an exit conveyor (not shown) are also provided at opposed ends of the apparatus 10.

In operation, a length of sheath S is drawn into the apparatus 10 from the supply reel 12 between the indexing rollers 44 and the overhead transport rail system 48 above the bundle B so as to determine the length of sheath S to be cut in accordance with the bundle length. Then, the sheath S is cut and sealed to form the closed downstream end of a bag for the underlying bundle B and a closed upstream end for the next bundle to be bagged. It is understood that the upstream end of the sheath S has been previously sealed during a previous bagging cycle. After, the sheath S has been cut and sealed, the overhead transport rail system 48 is powered back to displace the so-formed downwardly facing open bag directly above the underlying bundle B.

Then, the cylinders 76 and 80 are operated to displace the columns 70 and 72 towards the sides of the bag and the mouth thereof is opened by extending the lower suction members 102 next to the opposed external sides of the bag and by subsequently operating the vacuum pump to cause the lower end of the bag to be drawn against the perforated heads 104 of the lower suction members 102, as illustrated in FIG. 5. Once the mouth of the bag has been opened by the bottom suction members 102, the rotary gripping arms 110 are pivoted, as indicated by arrow 136 in FIG. 5, and the gripping fingers 118 and 120 thereof become closed against the sides of the bag. The suction at the perforated heads 104 of the lower suction members 102 is then stopped and the overhead transport rail system 48 is displaced to an open position thereof in order to release the closed upper end of the bag.

Thereafter, the bag is turned inside out over the four columns 70 and 72 by imparting a rotation of 180 degrees to the rotary gripping arms 110 in the direction indicated by arrow 138 in FIG. 5. The bag is then fitted about the columns 70 and 72 by linearly displacing the rotary gripping arms 110 to the upper end of the associated slot 114, as shown in FIG. 5. The bag is accumulated without folds in a fully expanded condition on the columns 70 and 72. The length of the column 70 and 72 is thus selected to be greater than the height of the product to be bagged and the corresponding depthwise dimensions of the bag. Air is then drawn into the upper suction members 106 to retain the bag and the gripping fingers 118 and 120 of all the gripping arms 110 are opened to release the bag therefrom. The open mouth of the bag is then at the upper end thereof.

Once the bag has been properly inverted and fitted about the columns 70 and 72, the cylinders 76 and 80 are actuated to stretch the bag in the transversal direction of the bundle B and the framework 24. Then, the ball screws 90 and 92 are operated to stretch the bag in the longitudinal direction of the bundle B. At this point, the vacuum pump can be shut down. The cylinders 158 are then extended to lower the arms 150 to position the tips 152 of the seams at the downstream and upstream ends of the bag against the corresponding faces of the bundle B, as illustrated in FIG. 7. The stretching procedure could be sequential or simultaneous, where all four columns 70, 72 move or where three columns 70, 72 move and one stays fixed or where two columns 70, 72 move and two stay fixed. Sequential stretching of the bag in the transversal and longitudinal directions is preferred in that in reduced the stress applied on the sheath material.

Figure 12:
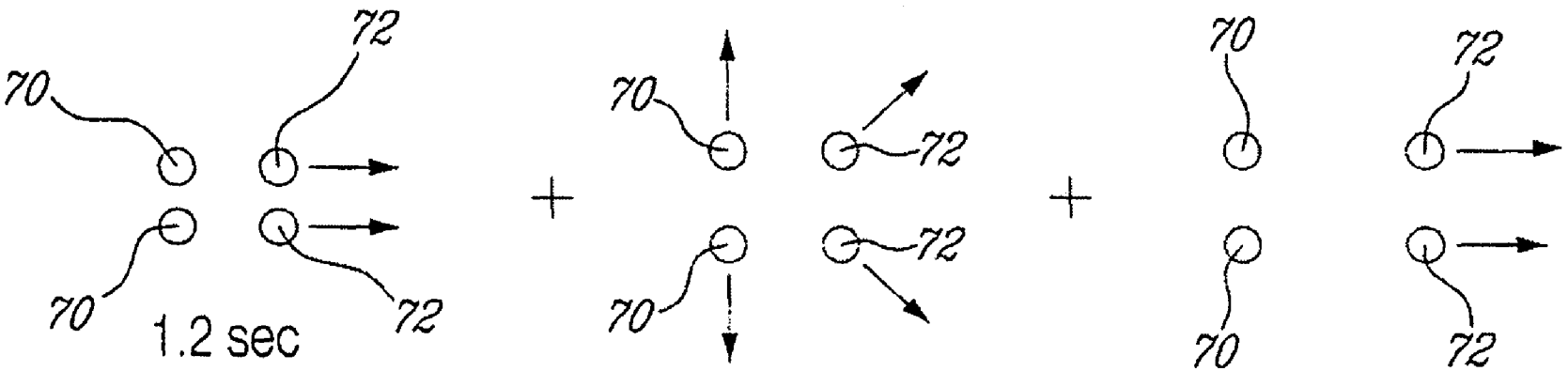
FIG. 12 is a schematic representation of a preferred bag stretching sequence.

FIG. 12 illustrates a preferred bag stretching sequence. The downstream columns 72 are first displace in an axially downstream direction (i.e. parallel the central axis of the apparatus) away from the upstream columns 70. The bag is maintained is this first stretching state for about 1.2 seconds. Then, the upstream columns 70 are displaced laterally outwardly while the downstream columns 72 are simultaneously displaced at a same rate in a downstream direction and a laterally outward direction. The movement of the downstream columns 72 has thus a lateral or transversal component (i.e. perpendicular to the central axis of the apparatus) and a longitudinal axial component (i.e. parallel to the central axis of the apparatus). The distance traveled by the upstream columns 70 and the downstream columns 72 in the transversal direction is equal. Finally, the downstream columns 72 are further displaced away from the upstream columns 70 in a purely axially downstream direction. This stretching procedure has been found to induce less stretching marks at the corners of the bags.

The taut open end bag is then lowered onto the underlying bundle by actuating the ball screws 128 so as to downwardly displace the sheath lowering plates 124 and cause the bag to be inverted on the bundle B as the top surface of the bundle B engages the bottom closed end of the bag opposite the open end thereof. Once, the bag has been fitted on the bundle B with the tips 152 of the seams folded inwards, the arms 154 are retracted and the plates 124 are displaced upwardly. The stretching columns 70 and 72 are then returned to their initial positions. Thereafter, the bagged bundle is displaced to a storage location and another bundle may be bagged as per the cycle described hereinabove.

Figure 9:
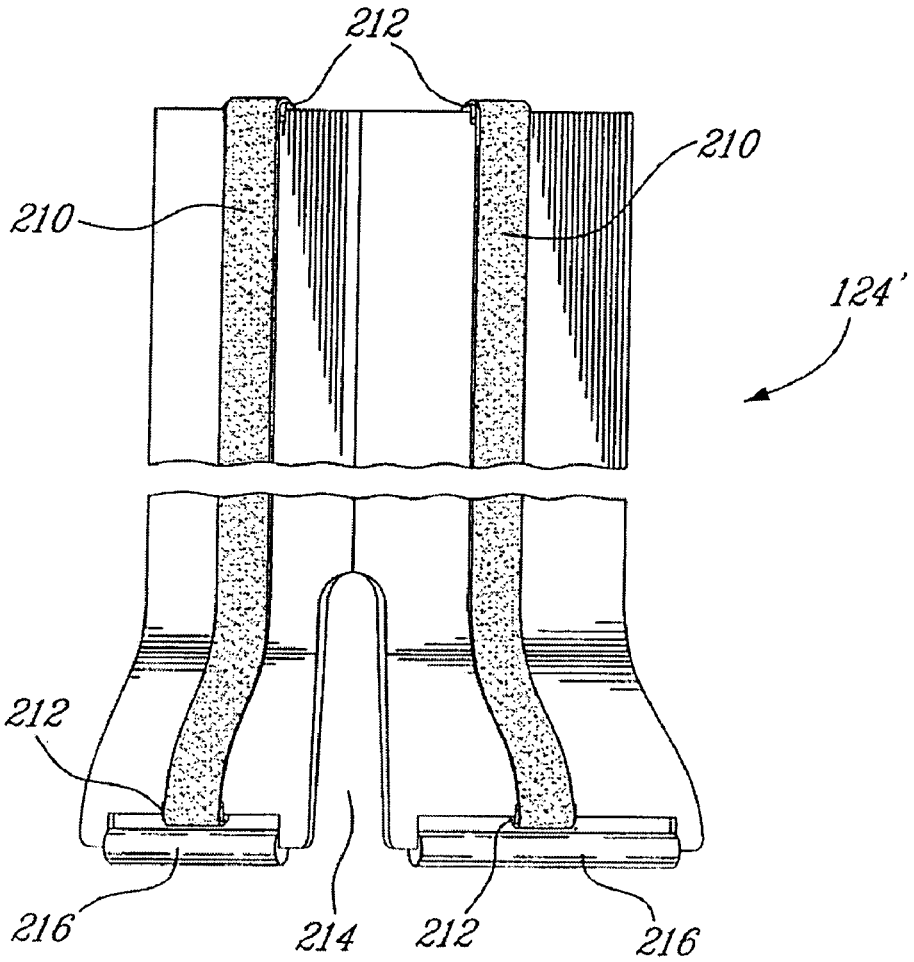
FIG. 9 is a schematic elevation view of a sheath lowering plate of one of the stretching column in accordance with another embodiment of the present invention.
Figure 10:
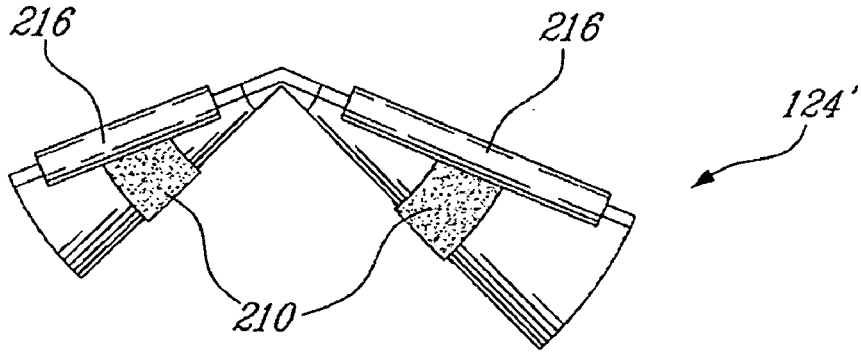
FIG. 10 is a bottom plan view of the sheath lowering plate shown in FIG. 9.

FIGS. 9, 10 and show other possible embodiments of a sheath lowering plate 124'. As shown in FIG. 9, each sheath lowering plate 124' includes first and second vertical panels extending from a common corner and equipped with at least one movable strap 210 (two in the example shown in FIGS. 9 and 10 and one in the example of FIG. 11) to help the sheath to slide off itself over the sheath lowering plate 124'. Each strap 210 extends longitudinally over opposed front and back faces of the sheath lowering plate 124' and runs over pulleys, rollers 212 or other suitable driving elements provided at opposed upper and lower ends of the sheath lowering plate 124'. The straps 210 are preferably power driven. For instance, a bi-directional motor (not shown) could be operatively connected to one of the rollers 212 engaged with the straps 210 to drive the straps 210 in one of first and second directions. It is also understood that the straps 210 could be provided in various forms, including any suitable movable endless belt or chain-like members.

Figure 11:
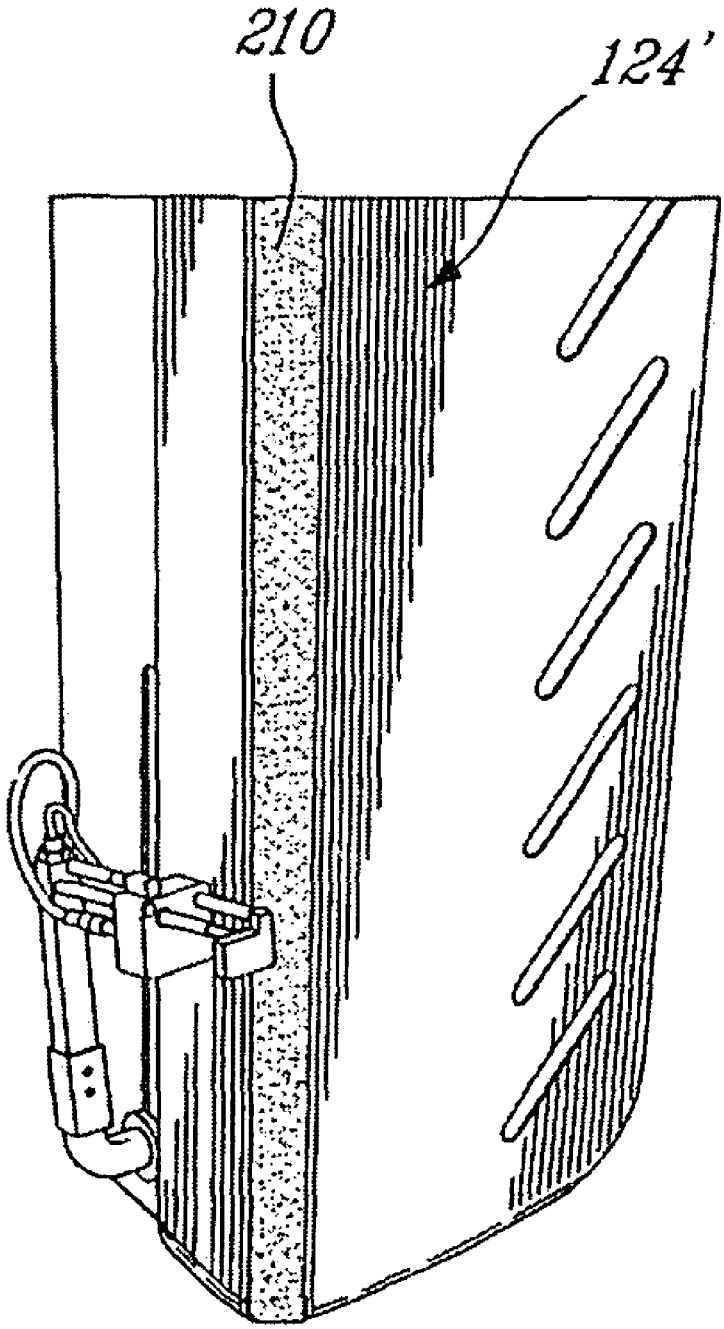
FIG. 11 is a side view of a one of the stretching column having one mechanically driven strap provided on the outer corner thereof.

In the event that only one movable strap 210 is provided by sheath lowering plate 124' as shown in FIG. 11, the moveable strap 210 is preferably centrally located relative to the plate 124' (i.e. at the outside corner thereof). If there are two moveable straps 210 then they could be located at a certain distant, preferably but not necessarily equidistant to the center of the plate 124'. If there are three moveable straps then they could be located in a similar fashion to the 2-strap system however with a third strap in the center of the longitudinal plane or could be located in any geometry as long as it is in the longitudinal direction. It is also understood that there could be more than three straps per plate. Any suitable permutation is also contemplated.

In use, the straps 210 are first driven in a first loading direction to facilitate the loading of the bag over the columns 70,72 after the rotary arms 110 have been pivoted in the direction indicated by arrow 138 in FIG. 5 in order to turn the bag inside out. The straps 210 are subsequently driven in a second opposed direction to help the bag to slide off from the plate 124' while the same are lowered in order to apply the sheath over the underlying bundle to be bagged.

The use of movable straps 210 or the like is advantageous in that it contributes to minimize the stress on the sheath material and thus permit the use of thinner sheath material or films.

The coefficient of friction (CoF) of the moveable straps 210 has an effect on the overall quality of the bag and package. The portion of the thickness of the strap protruding from the outside surface of the plate 124' also influences the quality of the bag. For instance, a strap with a high CoF does not allow the film to move laterally on the bag stretching columns, whereas a strap with a low CoF does allow the film to move laterally on the columns. By allowing the film (or the bag) to move laterally, the film has the opportunity to equally distribute the tension on its full length rather than concentrate the tension in a given area. Although the overall degree of stretching is 3-5% (measured by taking the circumference of the un-stretched formed bag as compared to the overall circumference of the bundle), the degree of stretching at each corner can be as high as 30%. With this degree of stretch at the corners, it has been found that the film exhibits stretch marks and this becomes the weakest point in the package, especially at the top corners (i.e. the corners with 3 faces). By allowing the tension to more evenly and distribute itself, it has been found that there are less stretch marks at the top corners. The use of a high slip or low CoF strap allows the film to adjust itself (move) and better control the stretch factor. The areas with low tension equilibrate with the high tension areas. This result in material savings since a thinner film coupled with a low CoF strap works as well as a thicker film coupled with a high CoF strap. For instance, a 3.5 mil film+strap with 0.2. CoF works as well as a 4.0 mil film+strap with 1.0 CoF.

The CoF of the strap should be less than 0.3 and preferably about 0.1. A CoF of 0.14 has been obtained with a lubricated ropanyl EM 8/2 00+05 clear AS strap.

It has also been found that the thickness of the strap and more particularly the distance at which protrude the straps from the outer surface of the plates 124' of the stretching columns has an impact on the tension distribution in the film. For instance, a 1/16 inch thick strap provides better results than a 1/8 inch thick strap because it allows the film to move more easily and cause less tension in the film. Alternatively, a recessed strap could work as well. As a general rule, it can be said that the strap should not protrude more than 1/4 inch from the outer surface of the plate 124' and preferably less than 1/8 inch.

As shown in FIG. 10, the lower end of each sheath lowering plate 124' has a generally widening rounded configuration. The lower end of the plate 124' preferably generally extends along an arc of circle in a horizontal plane (instead of the two 90 degrees side portions at the upper end portion of the generally L-shaped plate 124'). This advantageously eliminates any sharp edges that could potentially damage the sheath during the sheath transfer process. It also contributes to more uniformly distribute the tension in the sheath during the stretching process in that it reduces the amount of stress applied to the corners of the bag which is known to be the most solicited regions of the bag.

Also an upwardly extending recess 214 is preferably provided in a central region of the lower end of the plate 124' at a location generally corresponding to the fold line of the upper L-shaped end portion of the plate 124'. The upwardly extending recess defines an arc which has a smaller radius than the one defined by the lower edge of the plate 124' in the horizontal plane. By so smoothing the lower corner region of the plate 124', the amount of stress applied at the corner of the bag can be reduced, thereby providing for the use of cheaper and thinner bagging materials.

Finally, as shown in FIG. 9, idle rollers 216 mounted for free rotation on respective axles can also be provided at the lower end of each corner plate 124' to facilitate loading and unloading of the bag on the corner plate 124'.

The invention claimed is:

1. A method of bagging an article into a stretchable bag comprising:

a) providing a stretchable bag having an opening for receiving the article;

b) loading the stretchable bag on first and second pairs of corner members of a stretching apparatus, the corner members being displaceable along first and second orthogonal directions;

c) stretching the bag by: i) displacing the second pair of corner members away from said first pair of corner members along said first direction while said first pair remains stationary, ii) displacing said corner members of said first pair away from one another along said second direction while at the same time displacing said corner members of said second pair outwardly at a same rate in said first and second orthogonal directions away from said corner members of said first pair, and finally iii) further displacing said second pair of corner members away from said first pair of corner members along said first direction; and d) lowering the stretchable bag in a taut open state over the article.

2. The method defined in claim 1, comprising holding the bag in a first taut open state for a predetermined period of time between steps i) and ii), and wherein the distance travelled by the first and second pairs of corner members in the first direction is equal.

* * * * *